US005271627A

United States Patent [19]

Russell et al.

[11] Patent Number: 5,271,627

[45] Date of Patent: Dec. 21, 1993

[54] REAL ENCOUNTER GAME FOR BALANCING THE BODY, MIND AND SPIRIT

[76] Inventors: Paul R. Russell; Alysn Hassenforder, both of 5005 N. Mesa Dr., Castle Rock, Colo. 80104-9318

[21] Appl. No.: 880,183

[22] Filed: May 7, 1992

[51] Int. Cl.[5] ..... A63B 71/04; A63B 71/06

[52] U.S. Cl. ..... 273/445; 273/440; 273/446; 273/454; 482/84

[58] Field of Search ..... 273/440, 444, 446, 454; 482/83, 84, 86

[56] References Cited

U.S. PATENT DOCUMENTS

| | | | |
|---|---|---|---|
| 4,027,875 | 6/1977 | Hurley | 482/84 X |
| 4,088,315 | 5/1978 | Schemmel | 482/84 X |
| 4,534,557 | 8/1985 | Bigelow et al. | 482/84 |
| 4,627,620 | 12/1986 | Yang . | |
| 4,974,833 | 12/1990 | Hartman et al. | 482/84 X |

FOREIGN PATENT DOCUMENTS

| | | | |
|---|---|---|---|
| 1203258 | 4/1986 | Canada | 482/84 |
| 2232039 | 1/1973 | Fed. Rep. of Germany | 482/84 |

*Primary Examiner*—V. Millin
*Assistant Examiner*—Raleigh W. Chiu

[57] ABSTRACT

A multidimensional equilateral angular game playing apparatus and method include electronically controlled, life-sized obelisk "opponents" in the vertex of each angle. A sound generator and multiple lighted targets are mounted upon variously angled surfaces of each obelisk so that a target becomes momentarily active when its light is illuminated and a sound generator mounted upon the obelisk holding the target is actuated. The sequence of targets presented to a player and the time duration of each activation may be selected in a random manner by electronic controls. A single player strikes activated targets using thrusting and sweeping motions of a double-sided, padded playing staff. Upon successfully striking a target, the sound generator upon which obelisk the target is mounted emits a tone verifying the success of the strike, a point is added to a total sum of successful strikes, the target is deactivated and the next target is immediately presented to the player. Therefore, the speed of the game changes according to the reaction time of each individual player. A score of successful target strikes and total number of targets presented are displayed to the player. Physical agility and stamina, mental concentration and an indomitable spirit are tested and cultivated by the game.

20 Claims, 5 Drawing Sheets

REAL ENCOUNTER GAME FOR BALANCING THE BODY, MIND AND SPIRIT

TECHNICAL FIELD

The present invention relates to a game playing apparatus and method, providing an amusement, a game, a sport and a sport training device. A player experiences and develops skills of intuitive action and single minded focus, as well as physical traits of speed, accuracy, endurance and reflex quickness. The present invention was conceived as "experiential art", a mixture of art, a psychological hands-on exhibit and an entertaining game. The game is intended to integrate and interact with a participant on the levels of body, mind and spirit.

BACKGROUND OF THE INVENTION

Games or sports training devices for the purpose of testing or improving a player's reaction time exist in the prior art. For example, U.S. Pat. No. 4,627,620, entitled "Electronic Athlete Trainer for Improving Skills in Reflex, Speed and Accuracy", issued to J. P. Yang on Dec. 9, 1986, describes a game apparatus which includes an electronic device for randomly selecting a target from a group of multiple targets. The targets are moveable and may be individually placed by the player in desired locations. A selected target provides an audio and light cue (an illuminated LED, located near the target face) to which the player reacts by striking the target. This striking may occur in a variety of manners such as hitting, kicking or throwing an object at the target. The game does not advance to a next target until a player has hit a selected target. All targets must be hit to complete the game, however long it takes. The electronic device determines a score, the elapsed time for a player to react to a sequence of selected targets. The purpose of the Yang device is to improve athletic skills in reflex, speed and accuracy.

What is desired is a game which does more than test and develop a player's reaction time. What is desired is a game of "experiential art" with a unique format of presentation and implementation. Experiential art is more than a game or sport. It is a blend of materials, geometry and interaction that creates conditions for the experience of intense single pointed mental focus and, at the same time, an expanded awareness of the surroundings and physical boundaries.

SUMMARY OF THE PRESENT INVENTION

The game of the present invention simulates a battle encounter, in which a player using a fighting staff makes actual strikes against real computer-controlled obelisk "opponents" configured within a defined and fixed equilateral triangular playing area. The game integrates the body, mind and spirit in the ways of martial arts "warriorship" for everyday living. On a physical level, the game is good aerobic exercise, that requires stamina and sharpens a player's precision and speed of movement, as well as control of the amount of physical force used.

On a mental level, the game requires and sharpens single minded focus and concentration on the level of "active meditation". Intuition is drawn on to perceive the active target upon one of multiple obelisks.

On a spiritual level, the game challenges a player's integrity to do ones best at every moment. It challenges ones strength of character to persist and persevere in prolonged action. Once the game has begun, there is no stopping.

The game involves no physical threat to the player. It is a game of offense rather than defense, yet it is an intense, totally absorbing confrontation.

The game apparatus and method may be used in conjunction with personal development and body energy control (for example, "chi" energy or Aikido martial arts) seminars such as seminars for maintaining focus and calm under pressure. The game may be used in conjunction with biofeedback devices and techniques to help a player quickly learn to achieve a centered, single-pointed, focused state of mind and to sustain this state during stressful physical activity. This ability can be carried over into many activities of everyday life. Relaxation exercises or meditation performed prior to playing has led to marked improvement in the score of some players.

The apparatus and method force a player to use all senses to maintain a totally focused and alert state. Thus, the game may be a useful therapy for the hyperactive and those inflicted with certain types of mental or physical impairments. The game may help them to be more aware of their surroundings and body.

Individuals and teams may participate in tournaments of this game or sport, competing individually for the highest score or competing as a team for a combined highest score.

Players may also compete against others without risking physical contact using a configuration of two or more platforms in "tandem" play. Here, the same random target pattern is presented on two or more systems, simultaneously. The first player to strike a target receives a point and the other player or players lose the opportunity to score on that target.

A primary object of the game of the present invention is to provide a game which develops a players mental and physical skills in an environment of beauty, balance and grace. Targets are randomly selected from among clusters of targets on one or more opponents in a defined and fixed play area having a balanced, equilateral form. This form allows a rhythm of movement to arise as one plays, including intricate fast multiple strike patterns on a cluster of targets and then slower sweeping more graceful strikes between different opponents or clusters of targets. The apparatus may randomly invoke "mini-kata" sequences (a kata being set series of martial arts moves practiced repeatedly) to effectively train a player taking advantage of the arrangement of targets in clusters.

The preferred embodiment of the game is played on a fixed and defined equilateral triangular structure. This geometry is the preferred configuration to force a player to maintain focus and concentration, while expanding ones senses (sight and hearing) to encompass the entire 360 degrees around them. The player must be ready for an attack by any of the obelisks without being overwhelmed by facing too many obelisks. The triangular configuration represents the Pythagorean geometry of three equal parts for the balance and integration of use of the body, mind and spirit.

The game has special rules for foot movement and target striking techniques which emphasize the goal of maintaining balance and grace.

An important object of the present invention is to develop a player's concentration and focus skills. The time duration that each target is presented, as well as the sequence of presented targets, may be selected randomly. Since a target may become inactive before a player can strike the target, the player is forced to maintain concentration and continually deliver their fastest and most accurate strike. A player never knows how long they will have to strike a target. Therefore, the game of the present invention is much more than a test of reflexes and speed, but becomes a game of concentration and focus which develops the mind as well as the body.

The manner of scoring the game emphasizes that, although the game does test a player's reaction time, it also exercises a player's concentration and focus skills. Game scoring is a count of the total number of valid strikes within a predetermined period of time, rather than the total time to hit a set number of targets. Therefore, a player is forced to continue playing at the set speed or be left behind without scoring. If a player fails to stay focused and concentrated upon the game, the target lights and tone cues can become a confusing spinning blur, leaving a player flustered and unable to score points. This characteristic of the game of the present invention introduces an element of pressure, created by the constantly advancing sequence. The game teaches the experience of remaining calm and focused under pressure.

Although the game of the present invention includes a speed selection dial to set the pace of play, the player may automatically accelerate the speed of play, without changing the speed dial selection, by striking targets more rapidly. As soon as a target is struck, the game controller immediately presents the next target, regardless of the planned presentation time. This forces a player to learn to pace themselves and not needlessly expend more energy than is necessary to accomplish a goal of perfectly striking every target, without failure.

A further object of the game of the present invention is to provide for a player to develop and use both right and left sides of their body, thereby balancing their strength and control. The game employs a specific balanced, double sided playing staff with which the player can strike using either end.

Another object of the preferred embodiment of the present invention is to provide a game which may be played by a deaf player. The entire surface of a target is illuminated when a target is active. By virtue of the unique triangular geometry of obelisk placement, in dim light conditions a deaf player can depend solely on their peripheral vision for target cues upon target illumination.

Accordingly, the game playing apparatus of the present invention includes a playing arena in the form of an equilateral triangular playing arena. The playing arena defines the limiting boundaries of the playing area. Approximately at each corner of the triangular playing arena is located one of three upright human-sized obelisks. Multiple targets are mounted upon each of the obelisks. Each of the targets is comprised of a striking pad to receive strikes, a light for illuminating the striking pad and a sensor for detecting strikes upon the striking pad and for generating a strike signal when a strike is detected. A player uses a striking instrument to deal thrusting and sweeping strikes to the targets. A sound generator, which is adapted to generate at least two sounds, is mounted upon each of the obelisks. A controller governs the operations and play of the game playing apparatus. This controller includes circuits, such as a microprocessor, that sequentially activate the targets and command the sound generators to generate two or more distinct sounds. The controller directs a sound generator to emit a first "cue" sound when the controller activates one of the targets and the target is illuminated. The controller directs one or more sound generators to emit a second sound when the player successfully strikes a target. The controller also includes a timer circuit which it uses to time the durations each of the targets is active. The controller randomly selects the time a target is to be active and loads this time into the timer. If the timer expires before the player strikes the target, the controller selects a next target to activate. The next target may be selected at random or according to a predetermined and stored sequence. In addition, the controller has two counters, one to count the number of targets successfully struck and another to count the total number of targets presented. The game playing apparatus also includes a game timer to fix the duration of each game and a display for exhibiting the score counted by the two score counters.

Accordingly, the method for controlling play, associated with the game playing apparatus of the present invention, includes a first step of sequentially activating at least one target of multiple targets distributed among and mounted upon at least three obelisks, wherein the obelisks are positioned at each of the vertices of an equilateral angular playing arena. The sequence of presented targets may be determined at random or according to a predetermined and stored sequence. The next step is to illuminate a light within each target when the target is activated and, concurrently, to generate a sound from a sound generator and speaker upon the obelisk holding the activated target. The next step is to select a random activation time duration for the activation of each target and to time the activation of a target. The next step is to detect strikes delivered to an activated target by a game player using a playing staff. Upon detecting a valid strike of an activated target, the next step is to generate a second sound by one or more sound generators and speakers to indicate that a successful strike has been made. The next step is to count detected strikes, then to deactivate a target after it has been struck or after the timeout of the activation duration timer. The deactivating step includes deilluminating the light within the target. The final step is displaying the count of detected strikes.

BRIEF DESCRIPTION OF THE DRAWINGS

Further objects, features and advantages of the invention will become apparent upon consideration of the following detailed description in conjunction with the accompanying drawings, in which.

DETAILED DESCRIPTION OF THE INVENTION

Figure 1:
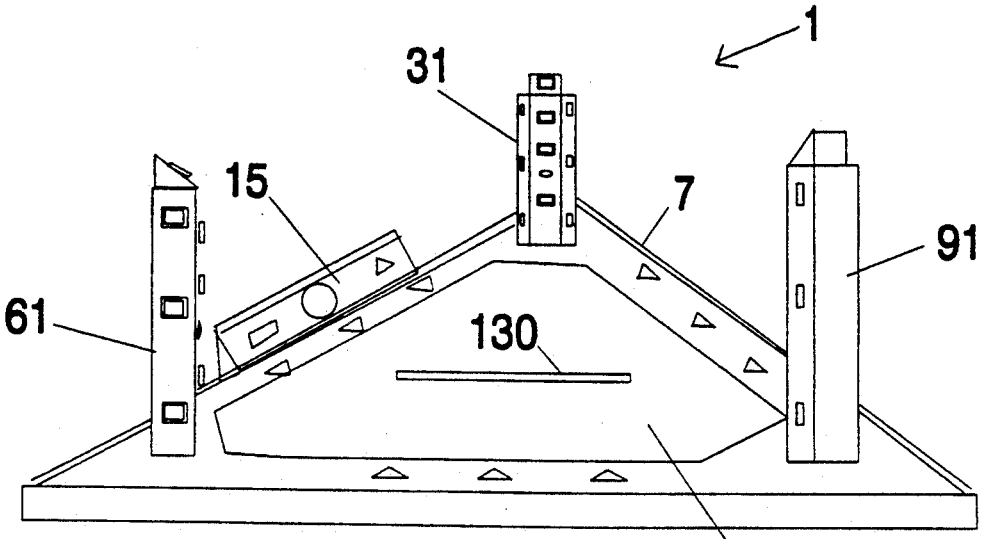
FIG. 1 depicts a perspective view of a game apparatus including an equilateral triangular playing arena, three upright obelisks and a control box along the side of the playing arena.
Figure 2:
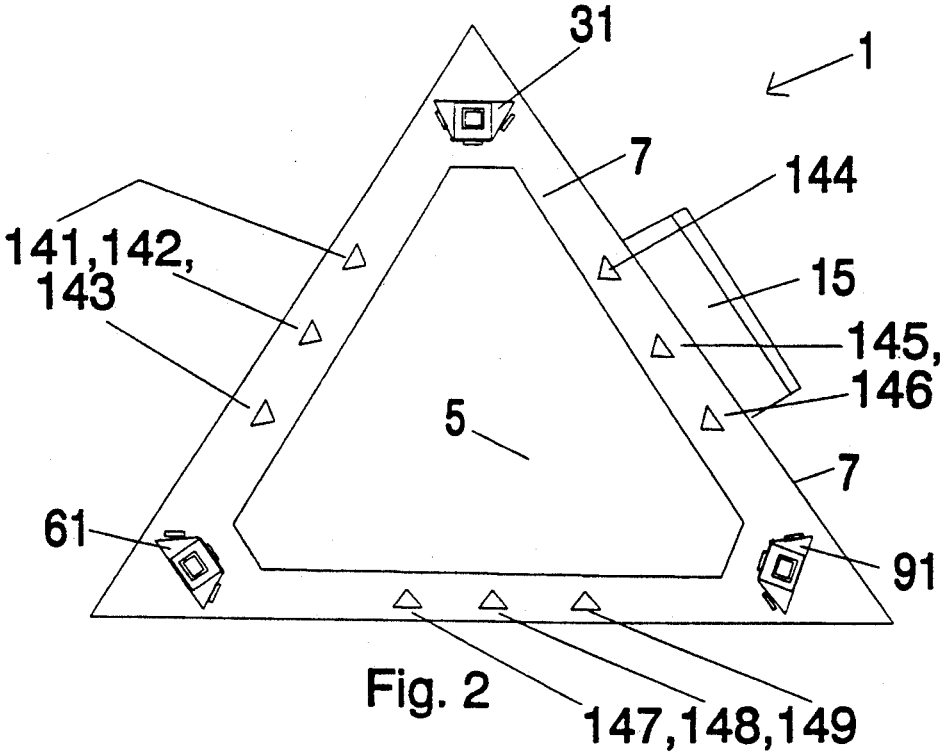
FIG. 2 illustrates a top view of the game apparatus, showing the trapezoid shape of the upright obelisks, three border lights which designate limits of the equilateral triangular playing arena, a border base support for holding the upright obelisks in place and the control box.

The physical appearance of the game apparatus is illustrated in FIGS. 1 through 4. FIG. 1 illustrates a perspective view of the preferred embodiment of the game playing apparatus 1, including an equilateral triangular playing arena 5, a control box 15 mounted adjacent to a triangular playing base 7 and three upright abstract obelisk "opponents", shown as obelisk 1 31, obelisk 2 61 and obelisk 3 91. The equilateral triangular playing base 7, shown in FIG. 1 and FIG. 2, is constructed of dark stained hardwood and encloses a carpeted equilateral triangular playing arena 5. Three columnar obelisks, obelisk 1 31, obelisk 2 61 and obelisk 3 91 represent, in abstract form, life sized opponents. The obelisks are also constructed of dark stained hardwood. In the preferred embodiment of the invention, ten targets are mounted upon each obelisk, each side of the playing arena 5 measures twelve feet in length and each obelisk is approximately six and one-half feet in height.

FIG. 2 is a top view of the game playing apparatus 1, showing the abstract trapezoidal shape of the upright obelisks, obelisk 1 31, obelisk 2 61 and obelisk 3 91. Nine border lights 141 through 149 designate the legal playing area defined by the equilateral triangular playing arena 5. The triangular playing base 7 serves as a base support for holding the upright obelisks in place.

Figure 3:
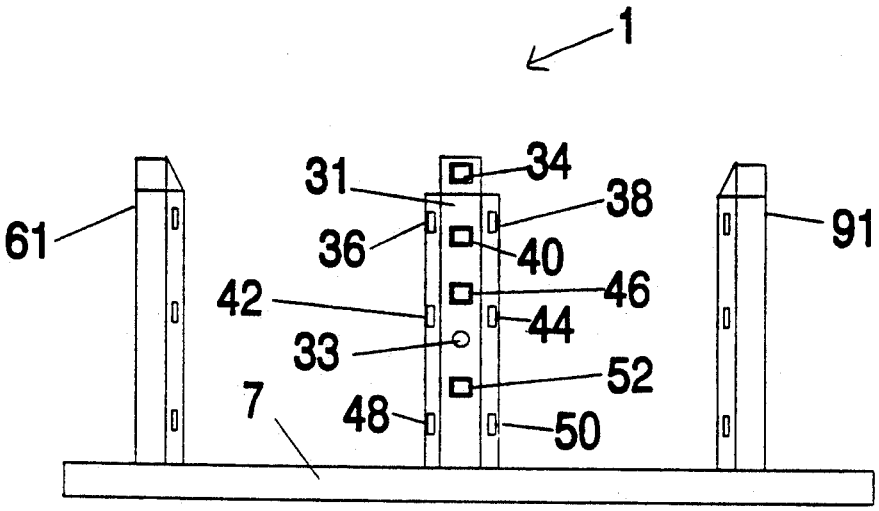
FIG. 3 illustrates a frontal view of the game apparatus, showing a full length perspective of one of the base sides and a detailed examination of an upright obelisk with multiple clusters of ten targets mounted on variously angled surfaces of the obelisk and a cue tone generator speaker (the targets and speaker are repeated on each of the other obelisks)

FIG. 3 is a frontal view of the game playing apparatus 1, showing the full length, approximately 12 feet, of one of the sides of the triangular playing base 7. FIG. 3 illustrates the detailed structure of obelisk 1 31, upon which a cue tone speaker 33 and targets 1 through 10 (labelled even numbers from 34 through 52) are mounted. The targets are mounted in multiple clusters on variously angled surfaces upon the obelisk. The intricate wood work, natural colors, glowing blue lights and the geometric shapes create a state of mind of purpose and inward attunement to mentally prepare the player for play. The configuration of ten targets and one cue tone speaker is repeated on each of the other two obelisks, obelisk 2 61 and obelisk 3 91.

Figure 4:
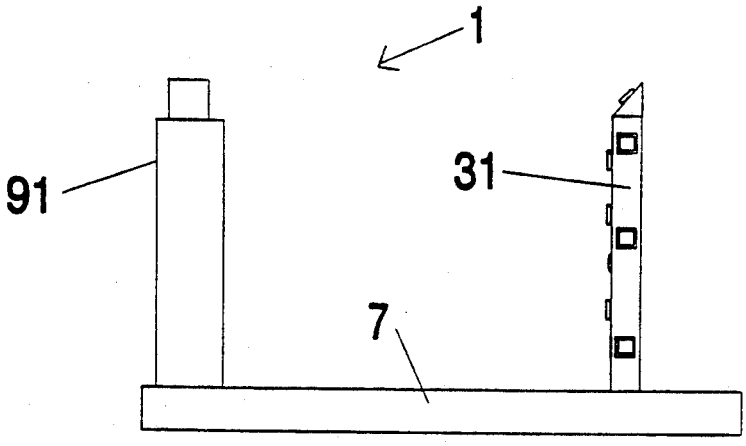
FIG. 4 illustrates a side view of the game apparatus.

FIG. 4 illustrates a side view of the game playing apparatus 1, showing the mounting of upright obelisk 1 31 and obelisk 3 91 upon the triangular playing base 7. Obelisk 2 61 is located behind obelisk 3 91 and is not visible in this view of the game playing apparatus 1. The obelisks are each approximately 6.5 feet tall in the preferred embodiment of the game.

Figure 5:
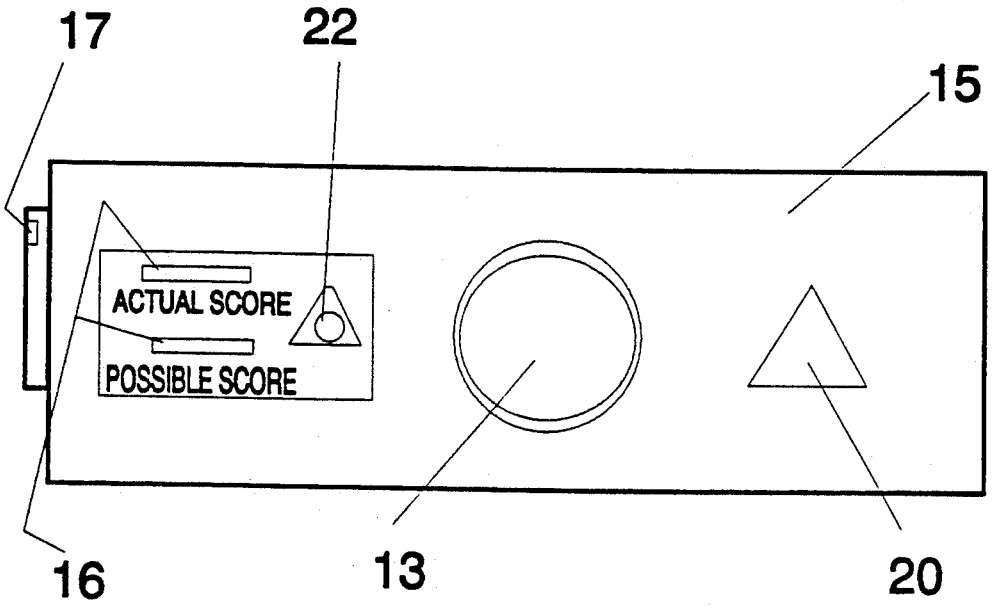
FIG. 5 depicts the control box, including a coin drop, game speed dial, a start button, a main tone generator speaker and a score display.
Figure 6:
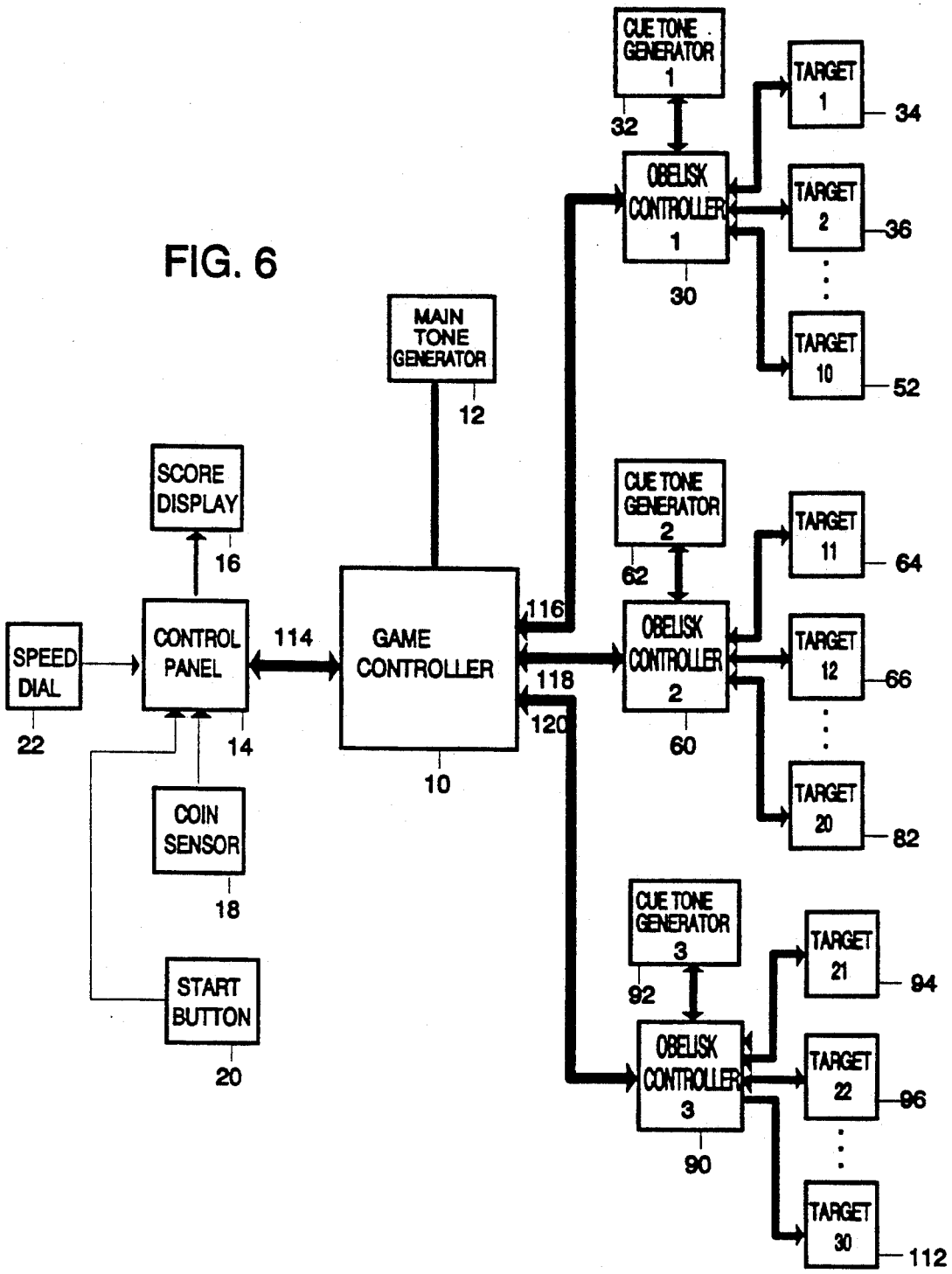
FIG. 6 is a block diagram of an illustrative embodiment of the invention including electronic control components.

FIG. 5 illustrates a frontal view of the control box 15, which contains control panel electronics 14 of FIG. 6. A player initiates a game, setting game electronics into a reset state, by placing a game token into a coin drop 17 to actuate a coin drop sensor 18 of FIG. 6. The player selects a level or speed of play by manipulating a speed dial 22 and starts the game by pressing a start button 20. FIG. 5 also depicts a score display 16 which informs a player of the number of targets successfully struck (the actual score) and the number of targets presented (the possible score). A main tone speaker 13 sounds a "gong" tone to start or end a game and sounds a different tone upon the occurrence of a successful strike.

Referring to FIG. 6, a block diagram illustrating the components of the preferred embodiment of the invention, a game controller 10, which may be a microprocessor, sends commands to a plurality of obelisk controllers 30, 60 and 90 to drive multiple targets, sends score information to a control panel 14 to exhibit this information on a score display 16, receives signals from the control panel 14 and the obelisk controllers and ultimately controls playing of the game. The score display 16 exhibits two scores, the number of targets presented and the number of targets hit correctly. This allows a player to be totally absorbed in the "act of play" without having to keep track of their progress as they play. Although the preferred embodiment of the game is described using processor control, electronic control of the game may be accomplished using either analog circuits, discrete digital components or processor control.

The controller 10 places the game in a standby mode in response to a "ready" signal from a coin sensor 18 which actuates a signal to the control panel 14 which, in turn, communicates this signal to the controller 10 by means of an input/output port A 114 when a player deposits a token into a coin drop 17 of FIG. 5. In standby mode, the controller 10 illuminates a light (see 136 of FIG. 7) within each target. In the preferred embodiment of the game, there are thirty targets (even numbers 34 through 52, 64 through 82, and 94 through 112). The controller 10 illuminates a standby light within each target (dim filament 136 of FIG. 7) by sending an "illuminate" signals via an input/output port B 116 to an obelisk controller 1 30, via an input/output port C 118 to an obelisk controller 2 60, and via an input/output port D 120 to an obelisk controller 3 90. Input/output ports A through D are standard communication ports which are common in the art of microcontrollers and microprocessors.

The player may then select a level of play (1 through 10) by operating a speed dial 22. A player standing within the equilateral triangular playing arena 5 of FIG. 2 and ready for play may "center" themselves (gather their concentration) prior to actuating the game by pressing a start button 20. This allows the player to insert a play token and have time to gather their thoughts and energy before beginning play. A signal line from the start button 20 to the control panel 14 couples with a "start trigger" signal from the control panel 14 to game controller 10 by means of the input/output port A 114.

A game begins when the game controller 10 receives the start trigger signal from the control panel 14 via input/output port A 114. The control panel 14 generates the start trigger signal in response to the ready signal from a coin sensor 18 followed by a start trigger signal from a start button 20. The controller 10 starts the game by sending start signals to obelisk controllers 1 30, 2 60 and 3 90 instructing the obelisk controllers to extinguish the lights (dim filament 136 of FIG. 7) in all targets 1 through 30 and to generate a "gong" sound in the main tone speaker 13 in FIG. 5. The game uses a deep gong sound to begin and end each game. The gong tone conditions the player to balance and focus themselves at the beginning of play. The gong tone also acts as a final trigger to define the end point of the "ready/alert" play condition at the conclusion of the play sequence.

A cue tone generator is mounted upon each obelisk. In addition, a main tone generator may optionally be included in the game playing apparatus 1. In one embodiment of the game, a main tone generator 12 is included in the game playing apparatus 1 and is mounted upon the control box 15 of FIG. 5.

Sound generators produce at least two tones. A cue tone is emitted from an obelisk upon activation of a target mounted upon that obelisk. The cue tone notifies the player that a target is active and assists the player in determining the location of the active target. A strike tone is emitted upon successful striking of an active target. In alternative embodiments of the game, the strike tone may either be emitted by the cue tone generator mounted on the obelisk upon which the struck active target is mounted, be emitted by the cue tone generators mounted upon all obelisks in unison, or be emitted by the main tone generator 12 alone, or be emitted by the cue tone generators mounted upon all obelisks plus the main tone generator in unison.

In alternative embodiments of the game, the gong tone, which signals the start of a game and signifies the end of a game when the game timer expires, may either be emitted by the cue tone generators mounted upon all obelisks in unison, or be emitted by the main tone generator 12 alone, or be emitted by the cue tone generators mounted upon all obelisks plus the main tone generator 12 in unison.

After the game controller 10 has extinguished the standby lights (dim filament 136 of FIG. 7) and begun play by evoking the "gong" sound, the game controller 10 then starts a game timer which times the allotted duration of a game (for example, 4.5 minutes) and determines a sequence of targets to present to the player. The game controller 10 may randomly select targets and send a code identifying the selected target and audio "cue" signals to an appropriate obelisk controller 1 through 3 (30, 60 and 90). When one of its targets is selected, the obelisk controller controls the lights associated with each target to illuminate brightly and controls a cue sound generator to generate a tone. The game controller 10 presents a target to a player by sending a signal to the obelisk controller which controls that target. This signal is encoded to specify which target is to be presented to the player. The obelisk controller receiving this signal activates a "light power" line (see FIG. 7) to illuminate the designated target and signals the cue sound generator coupled to this obelisk controller to generate a "cue" sound. An obelisk controller illuminates a target light (bright filament 139 of FIG. 7) by sending a signal on a light power line. In this manner, when a target is selected by the game controller 10, the selected target upon an obelisk is illuminated and, at the same time, a cue tone is generated to audibly notify the player upon which obelisk the selected target is located.

The controller 10 may select these targets in a random sequence or in a preprogrammed sequence. The controller 10 also selects the duration of which a target is selected. The duration of activation may be random or a preprogrammed duration. In one embodiment of the game, the sequences and target durations may be randomly determined by the game controller 10 and a memory (not shown) within the game controller may record a list of these sequences and durations. The player may then choose to play an identical game by means of input signals (not shown) to the control panel 14.

In different embodiments of the game, the game controller 10 may activate the targets one at a time, or multiple targets may be activated simultaneously, or a combination of activation schemes may be presented.

The game controller 10 activates a target for only a short time. Upon the activation of each target, the game controller 10 increments a counter of the number of targets presented which resides in the game controller 10 memory. The player uses a light weight, padded, double-sided playing staff 130, shown in FIG. 1, to strike at a target using thrusting and sweeping motions. A common length for the staff 130 is approximately 50 inches, although the length may vary according to the size of a player. A player may strike targets using either end of the staff 130. The targets are placed upon multiple sides of each obelisk. In the preferred embodiment of the invention, the targets are placed in clusters upon each obelisk. As is illustrated by FIG. 3 for obelisk 1 31, of the ten targets upon each obelisk, a single target 34 is placed upon the top of the obelisk signifying the head of an opponent. Three targets are placed in the shoulder area, one target 40 on the surface facing the center of the equilateral triangular playing arena and two targets 36 and 38 placed on the sides of the obelisk. Three targets are placed in a similar manner, on the front (target 46 for obelisk 1 31) and sides (targets 42 and 44) of the obelisk in the midsection area of each obelisk and the knee area (targets 48, 50 and 52). It may be intended that the player strike targets at the front of each obelisk using a thrusting motion and the targets on the side of the obelisk using a sweeping motion. When a player accurately strikes a target a target sensor 137 of FIG. 7 actuates a strike signal which is coupled to the obelisk controller which governs that particular target. The target sensor 137 may be a mechanical button device, a piezoelectric transducer, an electromagnetic sensor, an optical sensor or another type of sensor as is known in the art of transducers. Again referring to FIG. 6, upon receiving the strike signal, the game controller 10 increments a successful strike counter in game controller memory, sends out signals to deactivate the last target and to activate the next target selection. If the player successfully strikes a target while it is activated, the target 1 through 30 sends a strike signal to its associated obelisk controller 1 through 3, which the obelisk controller relays to the game controller 10 by means of the input/output ports B, C or D coupled to the obelisk. When the obelisk controller 1 through 3 (30, 60 or 90) receives this strike signal, it activates the main tone generator 12 to generate a "strike" signal by means of main tone speaker 13 (of FIG. 5). The strike tone is different from the cue tone. The strike signal is a tone which notifies the player that the strike was successful. In an alternative embodiment of the game, upon a valid strike signal to the game controller 10 may be relayed to all obelisk controllers to provide for generation of strike tones by all cue sound generators 1 through 3 (32, 62 and 92) in unison. The game controller 10 increments a score tally in memory upon receiving the relayed strike signal from an obelisk controller. Upon receiving a strike signal, the selected obelisk extinguishes the light (bright filament 139 of FIG. 7) in the target of the successful strike.

The game controller 10 immediately selects and activates a new target upon the successful striking of a previously activated target. If a target timer (not shown) within the game controller 10, which times the duration of the presentation of each target, expires before the player strikes the target, the game controller 10 will not increment the successful strike tally memory. Note that a counter of the number of targets presented was incremented at the time the target was selected. Therefore the difference between the targets presented counter and the successful strike counter is the number of failures to strike a target.

In the preferred embodiment of the game, the target sequence and the time duration of illumination (1 to several seconds) are randomly varied during the game. The game controller 10 causes each target to be presented for a randomly set period of time equal to 1, 2 or 3 time intervals "T", wherein "T" is the basic time unit for a given speed level. If a target is set to be presented for 3 times T units of time and it is struck by the player in less than that time, the successful score tally is incremented and the next target is immediately presented. In this manner, two different players may complete the game without missing a single target but each may receive a different score of successful targets struck since one player may have struck the targets more quickly and had more targets presented in the allotted game time. Thus, scoring of the game depends not only on the accuracy of a player in successfully striking the targets, but also depends on the players intensity of play or reaction time.

Play ends when the game controller's 10 game timer expires. The game controller 10 ends play in a similar manner to the procedure for starting play, by directing the main tone generator 12 to produce the "gong" tone and directing each obelisk controller 1 through 3 to illuminate all targets lights (dim filament 136 of FIG. 7) and actuate the main tone generator 12 to sound the "gong" tone on the main tone speaker 13.

Figure 7:
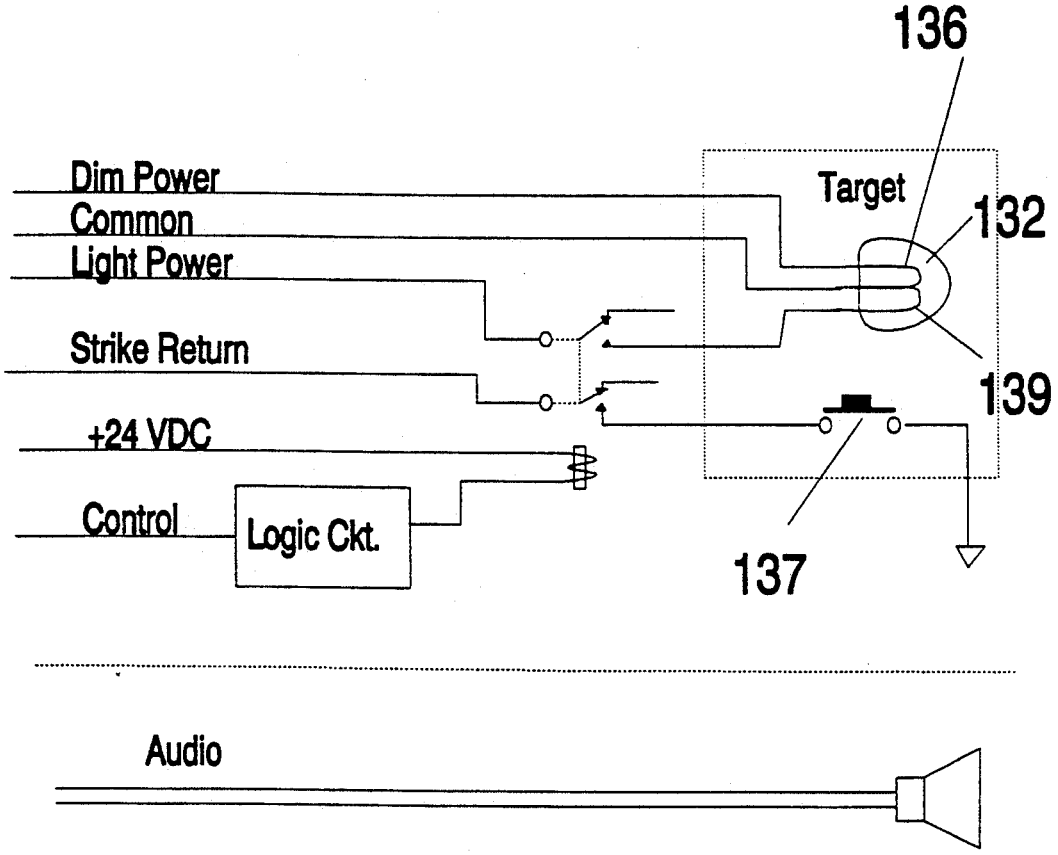
FIG. 7 is a block diagram illustrating the component parts of each target.

Referring to FIG. 7, a dual filament bulb 132 lights each target. A bright filament 139 lights each target when the target is "active" or "selected". A dim filament 136 illuminates each target when the game is in a "standby" state. The standby lights are always illuminated while the game apparatus 1 is idle, making the game structure an attractive and inspiring art piece.

By the foregoing discussion, it is apparent that the present invention provides an apparatus and method for playing an enjoyable game while improving concentration and focus skills in addition to speed, quickness and reflex development.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

We claim:

1. A game playing apparatus adapted for play by a game player, comprising:

a striking instrument adapted for usage by a game player for performing thrusting and sweeping strikes;

an equilateral triangular playing arena defining spatial limits of play;

three upright obelisks, each located approximately at a vertex of said triangular playing arena;

a plurality of targets mounted upon each of said obelisks, each of said targets further comprising a striking pad to receive strikes from said striking instrument, a light adapted to illuminate said striking pad and a sensor adapted to detect strikes upon said striking pad and to generate a strike signal upon the occurrence of a detected strike;

a sound generator mounted upon each of said obelisks adapted to generate at least two distinct sounds;

a controller further comprising means for selecting at least one target of said plurality of targets, means for activating said at least one target, said activating means further comprising means for actuating said light of said selected target and means, acting essentially concurrently with said actuating means, for directing the generation of a first sound by said sound generator mounted upon said obelisk holding said selected target, means for selecting a random activation time duration for said selected target, means for timing said activation time duration, means for deactivating said selected target in response to the first to occur of two conditions, (1) the timeout of said timing means and (2) the strike signal generated by said selected target sensor, said deactivating means further comprising means for deactuating said light of said selected target and means, acting essentially concurrently with said deactuating means, for directing the generation of a second sound by said sound generator mounted upon said obelisk holding said selected target, and means responsive to said selected target sensor strike signals for counting a score of successful strikes of said target;

a game timer adapted to time a set duration of play; and a display adapted to exhibit the score of successful strikes.

2. An apparatus according to claim 1, wherein each of said obelisks is configured in three dimensions having a frontal planar surface extending vertically and horizontally and facing the center of said triangular playing arena, two side planar surfaces extending vertically and horizontally and facing at right angles to the center of said triangular playing arena, and a top planar surface, wherein said targets are positioned in clusters of at least one target upon said planar surfaces of each obelisk.

3. An apparatus according to claim 2, wherein each of said obelisks extends vertically upward from a lower section to a midsection to an upper section to a top surface and wherein a first target cluster is positioned approximately at the location of the lower section of said obelisks, a second cluster is positioned approximately at the location of the midsection of said obelisks, a third cluster is positioned approximately at the location of the upper section of said obelisks and a fourth cluster is positioned approximately at the position of the top surface of said obelisks and wherein the first, second and third clusters are comprised of three targets of which one target is positioned on the front surface of said obelisks facing the center of the triangular playing arena and one target is positioned on each of the sides of said obelisks.

4. An apparatus according to claim 1, wherein said controller activates said targets one at a time.

5. An apparatus according to claim 1, wherein said controller activates at least one of said targets at one time.

6. An apparatus according to claim 1, wherein said controller further comprises means for counting the total number of activations of said targets in a game and said display is further adapted to exhibit the score of successful strikes relative to the count of total number of activations of said targets.

7. An apparatus according to claim 1, wherein the light within each of said targets comprises a dim filament and a bright filament, said bright filament adapted to be illuminated when a target is activated and said dim filament adapted to be illuminated before and after a game is in play.

8. An apparatus according to claim 1, wherein each of said sound generators is adapted to generate a distinct sound in addition to said two distinct sounds and wherein said additional distinct sound is a gong tone adapted to be sounded at the beginning and at the end of a game.

9. A game playing apparatus, comprising:

a striking instrument adapted for usage by a game player for performing thrusting and sweeping strikes;

an equilateral angular playing arena having at least three corners defining spatial limits of play;

at least three upright obelisks, each located approximately at a vertex of said angular playing arena;

a plurality of targets mounted upon each of said obelisks, wherein each of said targets further comprises a striking pad to receive strikes from said striking instrument, a light for illuminating said striking pad and a sensor for detecting strikes upon said striking pad and for generating a strike signal upon the occurrence of a detected strike;

a sound generator mounted upon each of said obelisks adapted to generate at least two distinct sounds;

a controller further comprising means for selecting at least one target of said plurality of targets, means for activating said at least one target, said activating means further comprising means for actuating said light of said selected target and means, acting essentially concurrently with said actuating means, for directing the generation of a first sound by said sound generator mounted upon said obelisk holding said selected target, means for selecting a random activation time duration for said selected target, means for timing said activation time duration, means for deactivating said selected target in response to the first to occur of two conditions, (1) the timeout of said timing means and (2) the strike signal generated by said selected target sensor, said deactivating means further comprising means for deactuating said light of said selected target and means, acting essentially concurrently with said deactuating means, for directing the generation of a second sound by said sound generator mounted upon said obelisk holding said selected target, and means responsive to said selected target sensor strike signals for counting a score of successful strikes of said target;

a game timer adapted to time a set duration of play; and a display for exhibiting the score of successful strikes.

10. An apparatus according to claim 9, wherein each of said obelisks is configured in three dimensions having a frontal planar surface extending vertically and horizontally and facing the center of said triangular playing arena, two side planar surfaces extending vertically and horizontally and facing at right angles to the center of said triangular playing arena, and a top planar surface, wherein said targets are positioned in clusters of at least one target upon said planar surfaces of each obelisk.

11. An apparatus according to claim 10, wherein each of said obelisks extends vertically upward from a lower section to a midsection to an upper section to a top surface and wherein a first target cluster is positioned approximately at the location of the lower section of said obelisks, a second cluster is positioned approximately at the location of the midsection of said obelisks, a third cluster is positioned approximately at the location of the upper section of said obelisks and a fourth cluster is positioned approximately at the position of the top surface of said obelisks and wherein the first, second and third clusters are comprised of three targets of which one target is positioned on the front surface of said obelisks facing the center of the equilateral angular playing arena and one target is positioned on each of the sides of said obelisks.

12. An apparatus according to claim 9, wherein said controller activates said targets one at a time.

13. An apparatus according to claim 9, wherein said controller activates at least one of said targets at one time.

14. An apparatus according to claim 9, wherein said controller further comprises means for counting the total number of activations of said targets and said display is further adapted to exhibit the score of successful strikes relative to the count of total number of activations of said targets.

15. A method for controlling a game, comprising the steps of:

selecting at least one target of multiple targets distributed among and mounted upon at least three obelisks, said obelisks being positioned at each of the vertices of an equilateral angular playing arena;

activating said at least one target;

actuating the illumination of a light associated with each target in response to the activation of said target;

concurrent with said illumination actuating step, directing the generation of a first sound by a sound generator mounted upon each obelisk in response to the activation of one target mounted upon said obelisk;

selecting a random activation time duration of activation of each activated target;

timing said time duration of activation of each activated target;

detecting strikes delivered to an activated target by a game player;

concurrent with said strike detecting step, directing the generation of a second sound by the sound generator mounted upon each obelisk in response to the detection of said delivered strike;

counting said detected strikes;

deactivating a target and deilluminating the light associated with said target upon the first to occur of two conditions, (1) the expiration of said time duration of activation timing step and (2) the detection of a strike of said target; and displaying the count of detected strikes.

16. A method according to claim 15, wherein said selecting step selects targets in a random sequence.

17. A method according to claim 15, wherein said selecting step selects targets in a predetermined sequence.

18. A method according to claim 15, wherein each of said obelisks are configured in three dimensions having a plurality of planar surfaces extending vertically and horizontally and projecting at various angles with respect to the center of said angular playing arena and wherein the targets are positioned in clusters of at least one target upon the variously angled planar surfaces of each obelisk.

19. A method according to claim 18, wherein each of said obelisks extends vertically from a lower section to a midsection to an upper section to a top surface and wherein a first target cluster is positioned approximately at the location of the lower section of said obelisks, a second cluster is positioned approximately at the location of the midsection of said obelisks, a third cluster is positioned approximately at the location of the upper section of said obelisks and a fourth cluster is positioned approximately at the position of the top surface of said obelisks and wherein the first, second and third clusters are comprised of three targets of which one target is positioned on the front surface of said obelisks facing the center of the equilateral angular playing arena and one target is positioned on each of the sides of said obelisks.

20. A method according to claim 15, further comprising the steps of:

counting the total number of target activations; and displaying the score of counted successful strikes of said targets in comparison to the count of total number of activations of said targets.

* * * * *